United States Patent [19]

Krapf

[11] Patent Number: 4,684,099

[45] Date of Patent: Aug. 4, 1987

[54] PIVOTALLY MOUNTED SCHEDULING BOARDS

[76] Inventor: Wallace A. Krapf, 1933 O'Neill Rd., Macedon, N.Y. 14502

[21] Appl. No.: 916,205

[22] Filed: Oct. 6, 1986

[51] Int. Cl.[4] ..... A47B 97/00

[52] U.S. Cl. ..... 248/447.1; 248/454; 248/455; 248/464; 428/100

[58] Field of Search ..... 428/99, 100; 248/447.1, 248/447.2, 452, 454, 455, 457, 464

[56] References Cited

U.S. PATENT DOCUMENTS

| | | | |
|---|---|---|---|
| 2,814,154 | 11/1957 | Krueger | 248/447.1 |
| 4,403,761 | 9/1983 | Jamar | 248/447.1 |
| 4,456,286 | 6/1984 | Jamar | 248/452 X |

*Primary Examiner*—Alexander S. Thomas

*Attorney, Agent, or Firm*—Shlesinger, Fitzsimmons & Shlesinger

[57] ABSTRACT

The board comprises a generally rectangularly shaped multi-layer panel section secured around its periphery in a rigid frame that is generally U-shaped in cross section. The panel section includes a plastic-coated metal layer forming the face of the board; and a plurality of bails are mounted on the back of the board for engagement by a plurality of hooks which are mounted on a wall so as to suspend the board therefrom. Two foldable arms are pivotally mounted on the frame adjacent its lower edge to extend parallel to the plane of the board when folded, and to extend normal to the board and to engage the wall and hold the board in an inclined position when unfolded. The frame prevents accidental dislodgment of the bails from the hooks when the board is moved to its inclined position.

15 Claims, 7 Drawing Figures

PIVOTALLY MOUNTED SCHEDULING BOARDS

BACKGROUND OF THE INVENTION

This invention relates to scheduling boards, and more particularly to scheduling boards of the type which have coated metal surfaces suitable for marking by write-on, wipe-off liquid chalk pens and the like, and to which surfaces magnetically-backed markers are releasably attachable in order to display information in the form of numerals, letters, symbols and the like. Even more particularly, this invention relates to novel apparatus for mounting a board of the type described on a vertical wall or support for tilting movement into and out of an operable position in which it is inclined to the wall or support upon which it is mounted.

Magnetic scheduling boards or display panels, such as for example the type disclosed in my U.S. Pat. No. 4,584,223, have long been used for a variety of purposes, such as for example scheduling events, equipment location, inventory control, etc. Information is displayed on the board or panel by using magnetically-backed symbols, letters and numerals, which are releasably attached to the face of the board. Also, of course, it is commonplace to employ easily erasable liquid chalk pens, or the like for writing or printing on the board faces.

Boards of the type described come in various sizes, and usually are rectangular in configuration. Various ways have been designed to support the boards during use. My U.S. Pat. No 4,386,475, for example, discloses wall-mounted tracks upon which the boards can be removably mounted for horizontal sliding movement in opposite directions. Instead of sliding movement, devices have also been provided for mounting the boards for pivotal movement about a vertical axis so that the boards can be swung, for example, flat to either side of a vertical axis. Wheel-mounted stands have also been provided for supporting the boards in a vertical plane, and in such manner that the stand can be easily rolled from one position to another when it is desired to move the board.

One of the shortcomings of prior such mounting devices has been the general tendency to support the scheduling boards in vertical planes, in much the same manner that a school blackboard is disposed in a plane parallel to the wall upon which it is mounted. In practice, however, this type of mount makes it rather inconvenient for one to write on the associated board, or for that matter to apply magnetically-backed markers in the proper place or places on the board. Ideally, the board should lie in a plane inclined slightly to the vertical, so as to make it easier for an operator to write or otherwise display information on the face of the board.

It is an object of this invention, therefore, to provide a relatively simple mechanism for mounting scheduling boards or display panels of the type described for pivotal movement between a first plane in which the board is disposed substantially parallel to an associated vertical wall or support, and a second position in which the board is inclined slightly to the vertical, and in such manner that the lower edge of the board is spaced further away from the support than the upper edge thereof.

Still another of this invention is to provide an improved mounting mechanism of the type described which is extremely simple to operate.

It is object also of this invention to provide an improved mounting mechanism of the type described which is designed to prevent accidental dislodgement of the board from the associated support during movement of the board between its operative and inoperative positions.

Other objects of the invention will be apparent hereinafter from the specification and from the recital of the appended claims, particularly when read in conjunction with the accompanying drawings.

SUMMARY OF THE INVENTION

Screwed to the back of a magnetic scheduling board or panel are two or more metal loops or bails which register longitudinally with each other. These bails are adapted to be hooked over associated, hook-shaped brackets, which are disposed to be secured to the wall upon which the board is to be mounted. When the bails are inserted over the hooks, the board is suspended by the bails in a plane inclined slightly to the wall, and generally with the upper edge of the board spaced slightly outwardly from the wall.

Pivotally mounted at opposite sides of the board adjacent its lower edge are two, foldable easel arms, which are pivotal between collapsed positions in which the arms are engaged against the rear face of the board in nearly coplanar relation thereto, and extended positions in which the arms are disposed to project rearwardly of the board and substantially at right angles thereto, so that the remote, terminal ends of the arms engage the surface of the associated supporting wall in order to hold the lower edge of the board a predetermined distance outwardly from the wall, thus placing the face of the board in a plane inclined to the wall, and in such manner that the lower edge of the board is now spaced further away from the wall than the upper edge thereof.

THE DRAWINGS

PREFERRED EMBODIMENTS OF THE INVENTION

Figure 5:
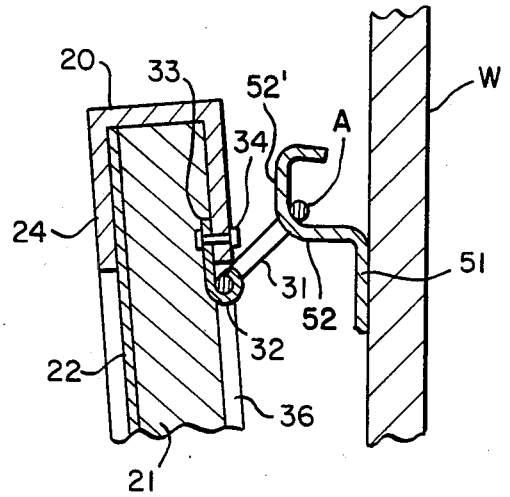
FIG. 5 is an enlarged, fragmentary sectional view taken generally along the line 5—5 in FIG. 1 looking in the direction of the arrows.
Figure 6:
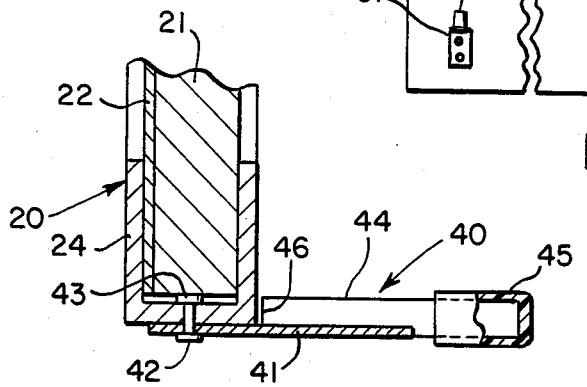
FIG. 6 is an enlarged, fragmentary sectional view taken generally along the line 6—6 in FIG. 4 looking in the direction of the arrows.

Referring now to the drawings by numerals of reference, 20 denotes generally a magnetic scheduling board or panel comprising a rectangular, multi-layer core section 21, at least one layer of which adjacent its display side, or left hand surface as shown in FIGS. 5 and 6, comprises a thin sheet 22 of metal to which magnetically-backed markers (not illustrated) are adapted to be attached releasably, when the board is in use. The outer peripheral surface of core 21, including its layer 22, is enclosed in a rigid, rectangularly shaped metal frame 24, which as shown in FIGS. 5 and 6 is generally U-shaped in cross-section. The exact composition of the core 21 forms no part of this invention, so it will not be described in greater detail herein. However, although in the drawings the sheet or layer 22 of metal has been shown to form the outer or display face of the board 20, it is to be understood that in practice this sheet is normally covered with one or more layers of plastic which enable information to be printed or otherwise marked on the face of the board with a liquid chalk pen, or the like.

Pivotally mounted on the back of the board 20 adjacent its upper edge is a plurality (two in the embodiment illustrated) of metal bails or loops 31. Each bail 31 is generally triangular in shape and has one leg thereof pivotally mounted in a nearly closed hook 32, which is formed along one edge (the lower edge in FIG. 5) of a bracket or strap 33, which is fastened adjacent its upper edge beneath one edge of the frame 24 by a rivet or bolt 34. It will be noted that the hook-shaped lower edge 32 of the strap 33 overlies the rear face of the core 21, and the adjacent, inner edge of the frame 20, so that a substantial portion of the hook 32 lies within the recess or opening 36 formed in the back of the board 20 by the inner, marginal edge of the frame 24.

Figure 4:
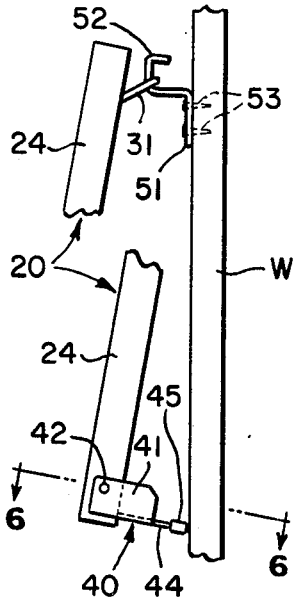
FIG. 4 is a view similar to FIG. 3, but showing the board in its erected or operative position.

Pivotally mounted at opposite sides of the board 20 adjacent its lower edge are two corner braces or easel arms 40. Each arm 40 comprises a generally rectangularly shaped side plate 41, which is pivotally connected adjacent one corner thereof by a rivet 42 to one of the two, opposed side surfaces of the frame 24. As shown more clearly in FIG. 6, each rivet 42 extends through the side wall of the frame 24 and has a headed inner end 43 overlying the inner surface of the frame 24 adjacent the core 21. Adjacent one end thereof (the right end as shown in FIGS. 4 and 6), each side plate 41 has an elongate, lateral flange section 44 (FIGS. 4 and 6), which extends at its outer end beyond the plate 41, and which has a thin, plastic cap 45 secured thereover for a purpose noted hereinafter.

Remote from its capped outer end, flange 44 has a plane, flat inner end or edge 46, which extends at right angles to the plate 41, and which is spaced a predetermined distance from the pivotal axis of the associated arm 40. As shown in FIG. 6, this horizontal distance, which is measured from the axis of the associated rivet 42 to the edge 46 of flange 44, is approximately equal to one half the thickness of the frame 24. Likewise, as shown more clearly in FIGS. 1 and 3, the side plates 41 of the arms 40 are pivotally mounted by their associated rivets 42 at points spaced vertically above the lower edge of the board 20 sufficiently to permit, as disclosed in greater detail hereinafter, the straight edges 46 on the associated flanges 44 releasably to engage the rear surface of the frame 24, when the arms are swung to their operative or extended positions as shown in FIGS. 4 and 6.

Figure 7:
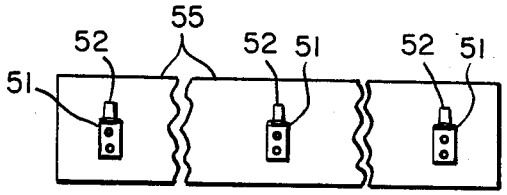
FIG. 7 is a fragmentary front elevational view showing part of a modified mounting mechanism in which the several board-supporting hooks are mounted on a separate support, rather than being secured directly to a wall surface.

In use, the board 20 is adapted to be pivotally supported adjacent its upper edge on a wall W, or the like. For this purpose the mechanism includes, for each bail 31, a bracket or plate 51 which has a tapered upper end which is bent into the shape of a hook 52 (FIG. 5). Each bracket 51 is adapted to be secured by screws 53 (FIGS. 3 and 4) or the like to the plane, a vertical surface of a wall W or similar support. In practice the brackets 51 are adapted to be secured to the wall W on sixteen inch centers, and in registry with the associated wall studs, which normally are on sixteen inch centers. For this purpose the brackets 51 can be shipped separately, and so mounted; or, alternatively, they can be prefastened on sixteen inch centers to a wooden template 55, or the like, as shown in FIG. 7, so that to assemble the mechanism the operator need only to fasten the template 55 to a wall, or the like, rather than fastening separate brackets 51 directly to the wall.

Figure 1:
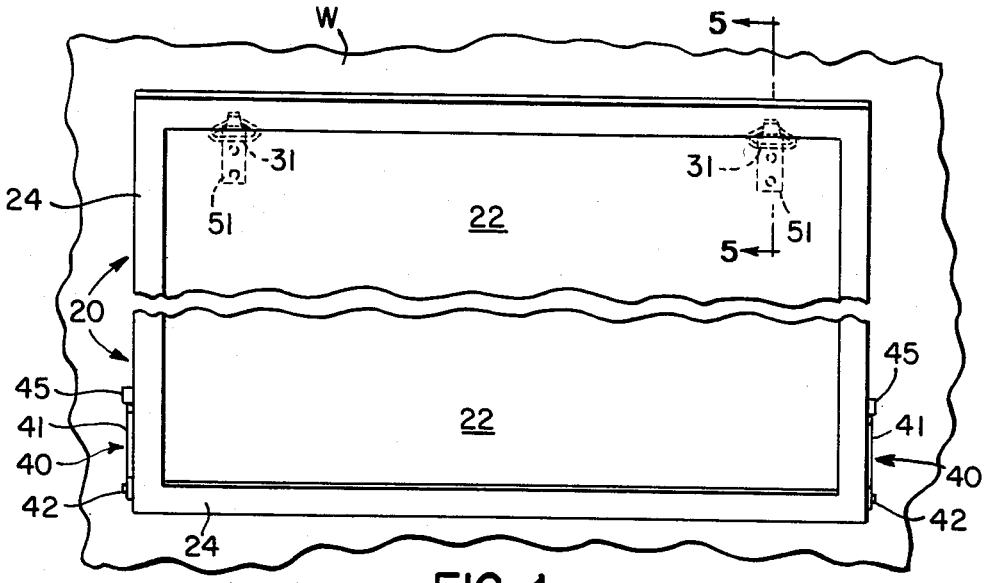
FIG. 1 is a fragmentary front elevational view of a magnetic scheduling board or panel shown mounted in a collapsed position on the face of a wall or the like by a novel mounting mechanism made according to one embodiment of this invention.
Figure 2:
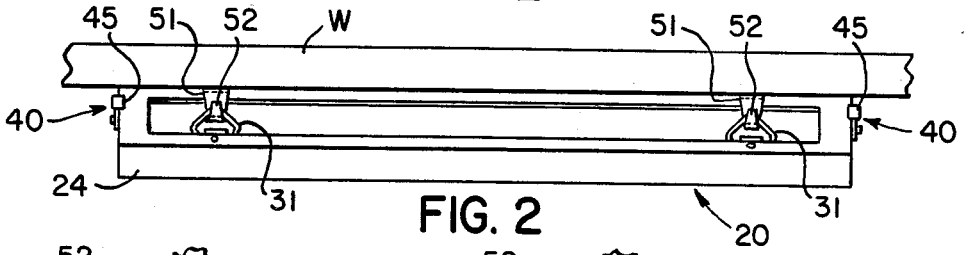
FIG. 2 is a fragmentary plan view of this collapsed board and mounting mechanism.

In any case, after the brackets 51 have been properly mounted on a support W the bails 31 at the back of the board 20 are inserted over the hooks 52 of the brackets 51, and in such manner that the bails 31 suspend the board from the hooks 52 as shown, for example, in FIGS. 1, 2 and 5. At this time one of the apices A (FIG. 5) that is formed by a pair of intersecting sides of each triangularly shaped bail 31 is seated in a respective hook 52 rearwardly of a vertically extending leg section 52' (FIG. 5) of the hook. Each leg section 52' has a length several times the diameter of the rod from which a respective bail 31 is formed, whereby each apex A of a bail 31 is spaced well beneath the upper, open end of a respective hook 52, when the board is suspended from the hooks.

Figure 3:
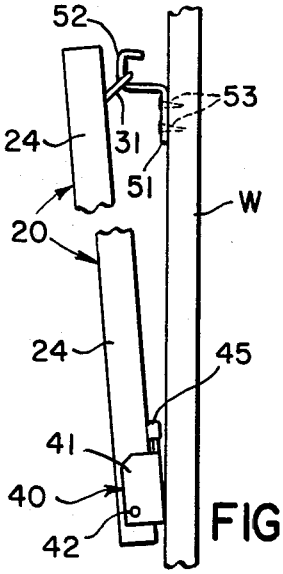
FIG. 3 is a side elevational view of this collapsed board and mounting mechanism.

When the arms 40 of a suspended board are in their retracted or folded positions as shown in FIG. 3, the board 20 will be inclined relative to the wall W as shown in FIGS. 1 to 3 and 5, wherein the lower edge of the board is positioned immediately adjacent to the wall W. However, whenever desired, an operator may manually tilt the board about the hooks 52 to swing the lower edge of the board away from the wall W, at which time the arms 40 may be tilted or folded clockwise about the rivets 42 in FIG. 3 from their collapsed to their extended or operative positions as shown in FIG. 4, wherein the plastic caps 45 engage the surface of the wall to retain the board in an operative position in which its lower edge is spaced a greater distance from the wall than its upper edge. The operating face of the board 20 is thus placed in a plane which is inclined slightly to the vertical, thereby making it easier for the operator to mark or otherwise arrange information thereon.

When the operator wishes to return the board to its retracted position, he or she need only to tilt or swing the two arms 40 back to their folded positions as shown in FIG. 3, which will then permit the board 20 to swing back to its collapsed position as shown in FIGS. 1 and 2.

From the foregoing it will be readily apparent that the present invention provides a relatively simple and inexpensive mechanism for releasably supporting a board of the type described in one of two different, suspended positions from a plurality of wall-mounted hooks. A primary advantage of this novel mounting mechanism is that it not only permits the board to be readily and releasably mounted on a wall or other such support, but it also enables the customer or operator easily to prop out the lower edge of the board from the wall, so that the board, in effect, forms an easel having an operating surface which is inclined in the vertical, and upon which surface the operator can more easily write or place magnetic markers for the purpose of displaying information and data.

By designing the foldable arms 40 so that they are mounted to pivot about axes which are spaced predetermined distances above the lower edge of the frame 24, it is possible to utilize the inner edge 46 of the lateral flange sections 44 of the arms in such manner that such edges 46 automatically cause the arms to stop in their desired, opened positions, when the arms are swung clockwise about the pins or rivets 42. Moreover, the upwardly tapering sides of hooks 52 cooperate with the triangularly shaped bails 31 to prevent any undersirable lateral or horizontal sliding movement of a suspended board during use; and the extra long vertical leg sections 52' of each hook 52 function to prevent the bails from accidentally popping out of, or otherwise being dislodged from, the hook 52 during swinging movement of the board between its collapsed and inclined positions. Furthermore, by housing the hook-shaped inner ends of the bail supporting plates 33 within the recess 36 in the back of the board 20, the inner edge of the frame 24 limits the counterclockwise pivotal movement of each bail 31, so that they lie in a common plane disposed at an acute angle to the plane of core 21. Consequently, during the swinging movement of the board 20 to its operative position (FIG. 4), the frame 24 thus tends further to retain the bails 31 securely within the hooks 52, so that the board does not tend accidentally to become dislodged from the hooks during this movement.

If desired, the arms 40 can be made freely to pivot on their respective rivets or mounting pins 42, such as for example making the diameters of the holes in plates 41 through which the rivets extend slightly larger than the diameters of the rivets. In this way, as soon as the lower edge of board 20 is swung away from wall W toward its inclined position, gravity will cause the arms 40 automatically to swing downwardly to their extended positions. In either their folded or extended positions, the flange sections 44 of arms 40 limit the pivotal movement of the arms to one or the other of their two limit positions.

While this invention has been illustrated and described in connection with only certain embodiments thereof, it will be apparent that it is capable of still further modification, and that this application is intended to cover any such modifications that may fall within the scope of one skilled in the art, or the appended claims.

I claim:

1. Apparatus for suspending from a vertical wall a scheduling board of the type having a generally rectangularly shaped, multi-layer panel section secured around its periphery in a rigid frame, comprising a plurality of bails, means mounting said bails on one side of said panel section to swing about a common axis extending adjacent and parallel to one edge of said panel section, a plurality of hooks secured to and extending from said wall releasably to register with and engage in said bails, thereby to suspend said board from said wall for limited pivotal movement about at least said common axis between a collapsed position in which the lower edge of said board remote from said one edge of said panel section is in proximate engagement with said wall, and an inclined position in which said lower edge of said board is spaced from said wall a distance greater than the upper edge thereof, and a plurality of support arms pivotally mounted each adjacent on end thereof on said frame adjacent said lower edge of the board for limited swinging movement between folded positions in which said arms are located adjacent and parallel to said panel section, when the board is in its collapsed position, and unfolded positions in which said arms extend tranverse to said panel section to have the opposite ends thereof engage said wall to hold the board in its inclined position.

2. Apparatus as defined in claim 1, wherein said mounting means comprises a plurality of brackets each secured adjacent one end to said frame at said one side of said panel section, and pivotally connected adjacent its opposite end to one of said bails to support the latter for limited swinging movement about said common axis, and means limiting the swinging movement of each of said bails in one direction about said common axis and operative to maintain said bails in a plane inclined to said panel section, when the board is suspended from said hooks.

3. Apparatus as defined in claim 2, wherein said limiting means comprises one edge of said frame engagable with said bails to retain the latter in a plane inclined at an acute angle to said panel section, when the board is suspended from said hooks.

4. Apparatus as defined in claim 1, including means mounting said support arms on said frame for swinging movement about a second common axis parallel to the first-named common axis.

5. Apparatus as defined in claim 4, including means on each of said arms for limiting the swinging movement thereof in one direction about said second common axis, and operative to retain said arms substantially at right angles to said panel section, when said arms are in their unfolded positions.

6. Apparatus as defined in claim 5, wherein each of said arms comprises a rigid plate mounted adjacent one end thereof to pivot about a pin which is secured to said frame parallel to said first-named common axis, and engagable at its opposite end with said wall, when the arm is in its unfolded position, and a flange projects laterally from said arm adjacent said opposite end thereof to overlie and engage the rear face of said frame when the arm is in its unfolded position.

7. Apparatus as defined in claim 6, wherein said opposite end of each arm has a plastic cap secured thereover.

8. Apparatus as defined in claim 1, wherein said mounting means comprises a plurality of brackets each having one end thereof extending beneath and secured to one side of said U-shaped frame in confronting relation to said one side of said panel section, and projecting at its opposite end beneath the adjacent edge of said frame, and each of said brackets having formed on said opposite end thereof a rolled edge disposed coaxially of said common axis and rotatably housing therein a portion of one of said bails to support the latter of limited swinging movement about said axis, said adjacent edge of said frame being positioned to limit the pivotal movement of said bails in one direction.

9. Apparatus as defined in claim 8, wherein said bails are held by said adjacent edge of the frame in a plane inclined at an acute angle to said panel section when the board is suspended from said hooks.

10. Apparatus as defined in claim 9, wherein said hooks are secured directly to said wall.

11. Apparatus as defined in claim 9, wherein said hooks are secured to a board which in turn is secured to said wall.

12. Apparatus as defined in claim 1, including means mounting said support arms on said frame for swinging movement automatically to their unfolded positions, when the board is swung toward its inclined position.

13. Apparatus as defined in claim 1, wherein each of said bails is generally tirangularly shaped in configuration, and is disposed to have one leg thereof mounted for pivotal movement about said common axis, and is disposed to have the apex formed by the other pair of its legs releasably positioned over one of said hooks.

14. Apparatus as defined in claim 13, wherein each of said hooks has thereon opposed side edges which are inclined toward each other in the direction of the terminal end of the hook.

15. Apparatus as defined in claim 13, wherein each of said hooks comprises a vertical leg section disposed parallel to and spaced from said wall, and operative to support the terminal end of the associated hook above and in overlapping relation to said apex of the bail positioned on the hook, and said vertical leg section of each hook has a length substantially greater than the thickness of the bail positioned thereon.

* * * * *